US005382003A

United States Patent [19]

Sankaranarayanan et al.

[11] Patent Number: 5,382,003

[45] Date of Patent: Jan. 17, 1995

[54] FLOW CONTROL DEVICE FOR THE SUPPRESSION OF VORTICES

[76] Inventors: Ramani Sankaranarayanan, 3440 Durocher St. Apt. 1016, Montreal, Quebec, H2X 2E2; Roderick I. L. Guthrie, 328 Roslyn Ave., Westmount, Quebec, H3Z 2L6, both of Canada

[21] Appl. No.: 136,071

[22] Filed: Oct. 14, 1993

[30] Foreign Application Priority Data

Dec. 8, 1992 [CA] Canada ..... 2084845

[51] Int. Cl.[6] ..... B22D 41/50

[52] U.S. Cl. ..... 266/230; 266/236; 222/594

[58] Field of Search ..... 266/227, 229, 230, 236; 222/594, 597, 591

[56] References Cited

U.S. PATENT DOCUMENTS

| | | | |
|---|---|---|---|
| 2,698,630 | 1/1955 | McShurley et al. | 137/312 |
| 3,596,804 | 8/1971 | Barrow et al. | 222/146 |
| 3,651,998 | 3/1972 | Rocher | 222/488 |
| 3,685,706 | 8/1972 | Fehling | 222/531 |
| 3,760,992 | 9/1973 | Bieri | 222/512 |
| 3,934,755 | 1/1976 | Rheinlander et al. | 266/230 |
| 4,200,210 | 4/1980 | Riegler et al. | 222/598 |
| 4,526,349 | 7/1985 | Schwer | 266/227 |
| 4,785,979 | 11/1988 | Svobodo et al. | 222/591 |
| 4,840,295 | 6/1989 | Hartley | 222/598 |
| 5,044,610 | 9/1991 | Koffron | 266/45 |
| 5,171,513 | 12/1992 | Vassilicos | 266/230 |

FOREIGN PATENT DOCUMENTS

| | | |
|---|---|---|
| 63-002539 | 6/1988 | Japan . |
| 63-040667 | 7/1988 | Japan . |
| 2226263A | 6/1990 | United Kingdom . |

OTHER PUBLICATIONS

"Vortex formation during drainage of metallurgical vessels" by Hammerschmid, Tacke, Popper, Weber, Debke & Schwerdtfeger Jun. 1984.

"Some Studies of Liquid Rotation and Vortexing in Rocket Propellant Tanks" by Abramson, Chu, Garza & Ransleben. Dec. 1962.

*Primary Examiner*—Scott Kastler

[57] ABSTRACT

A flow control device comprising a baffle plate and a plurality of dividers radially disposed about a nozzle through which liquid is to be discharged and adapted to space the plate from the nozzle. The device finds particular application in substantially eliminating any entrainment of a supernatant phase such as metallurgical slag or of an oxidizing atmosphere resulting from the formation of vortexing funnels disrupting liquid flow in a draining container.

11 Claims, 4 Drawing Sheets

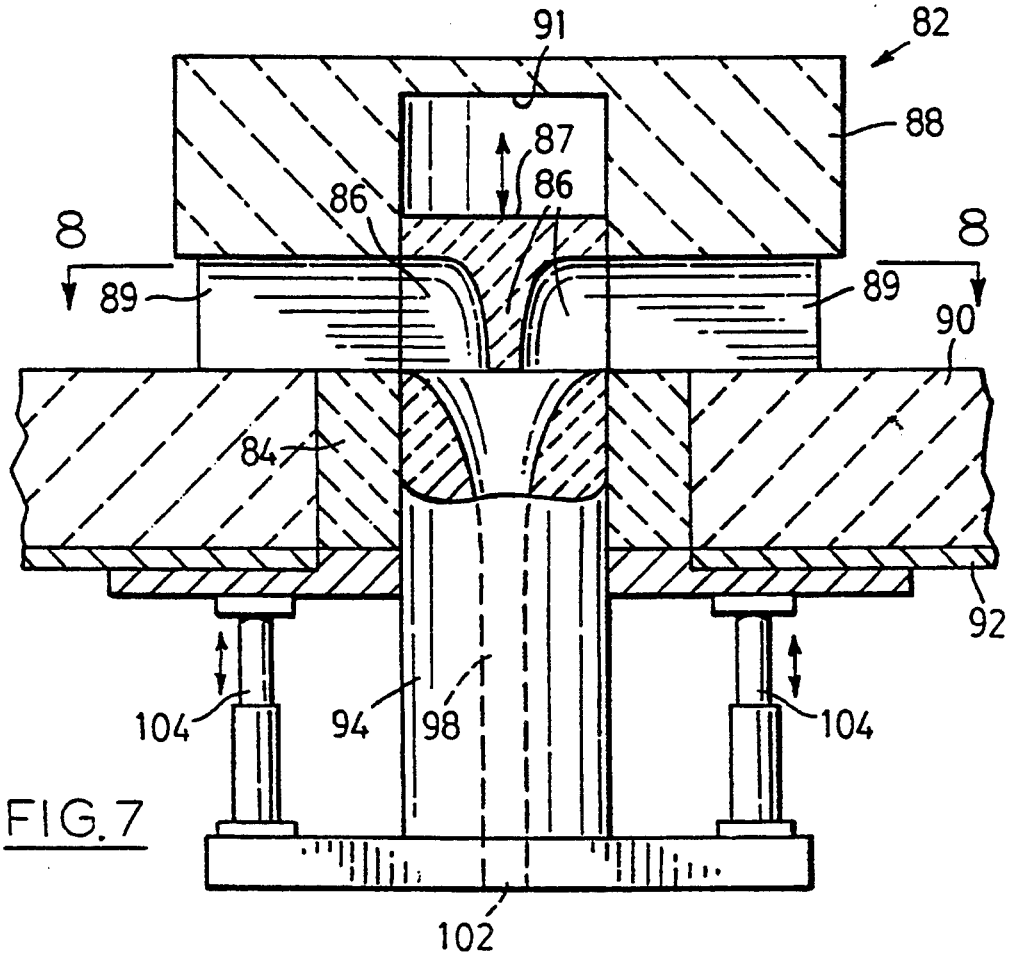
FIG. 7
FIG. 8
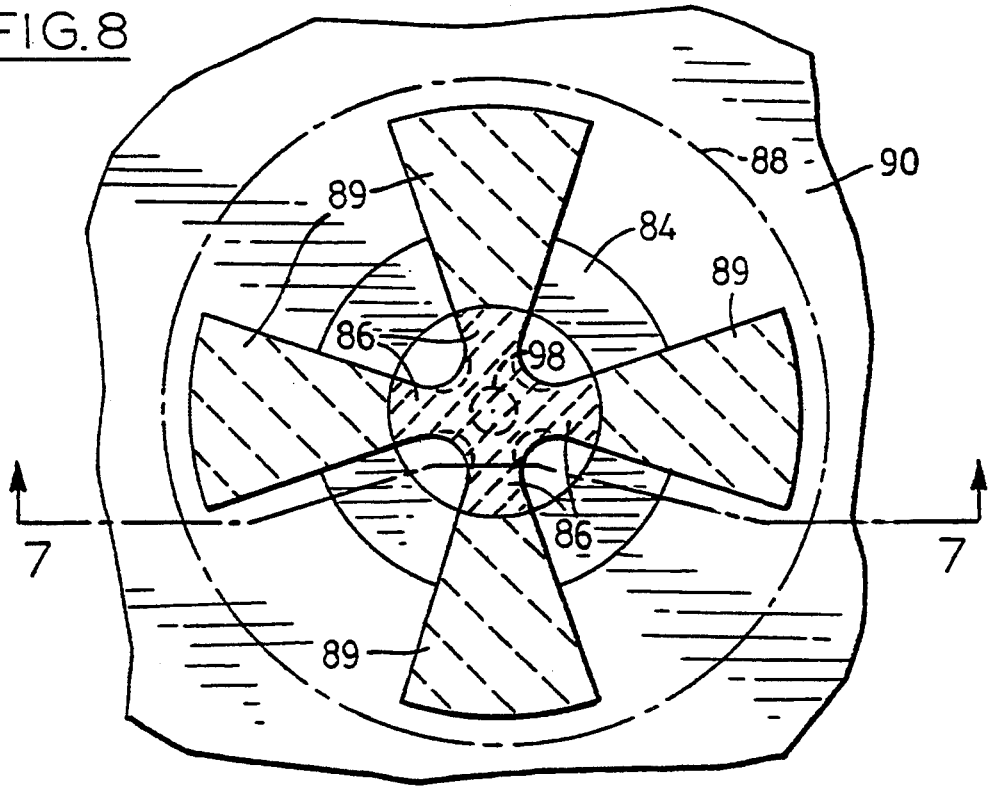

FLOW CONTROL DEVICE FOR THE SUPPRESSION OF VORTICES

FIELD OF THE INVENTION

This invention relates to a flow control device to be used to limit the formation of vortexing funnels or vortices as a liquid is discharged from a container, and more particularly to such a control device for use when discharging molten steel through a nozzle in the floor of a tundish, ladle or bottom-tapped Electric Arc Furnace (EAF), or the side-wall of a Basic Oxygen Furnace (BOF) Converter in its tilted-tapping position. The invention will also find application in fields other than metal processing and will for example be of use in the separation of stratified fluids, fractionating columns, fuel flow in propellant tanks and wherever the entrainment of a supernatant fluid (liquid or gas) has to be avoided during pumped, pressure or gravity-driven drainage on discharge of a liquid from a container.

For the purposes of this description, the invention will be described with reference particularly to the flow of liquid steel.

BACKGROUND OF THE INVENTION

It is usual when emptying steel from metallurgical vessels to separate an impurity containing slag (the supernatant light phase) from a partly refined liquid metal (steel) below. As the flow from the vessel takes place, it is not uncommon for a funnel or vortex to be created which can entrain large amounts of slag into the flow of liquid metal with resulting metal quality problems downstream. Further, the vortex can cause corruption of a desired streamline flow of liquid steel leaving the vessel.

Steelmaking vessels such as ladles and tundishes, BOF converters and EAFs are never emptied completely in order that slag entrainment via "vortexing" and "non-vortexing" funnels be avoided or minimized. This is necessary to avoid carry-over of slag from one vessel to another and results in a loss of product quality, yield and productivity.

Flow behaviour in an emptying vessel is influenced by the rotational velocity components in the liquid. In the absence of such velocity components, liquid leaving the emptying vessel is drawn mainly from a hemispheroidal region surrounding the exit nozzle, and surface liquid far above the drainage nozzle shows little motion. Towards the very end of the drainage, entrainment of the supernatant fluid does occur as a "non-vortexing" funnel through a funnel-shaped core.

When significant rotational velocity components are present in the liquid, and particularly when the axis of rotation of the rotational velocity components is within close proximity to that of the axis of the drainage nozzle, a significant proportion of the drainage outflow originates from the surface of the liquid and flows downwardly. The combination of the axial flow and the rotational velocity components leads to an increase in the tangential velocity about the nozzle axis in a region close to the axis with the eventual formation of a "vortexing" funnel.

A vortex can also result when the flow across the vessel floor experiences significant flow losses caused by such factors as poor nozzle design. Where the rate of flow of liquid across the vessel floor is interrupted and decreases, some axial downward flow is inevitable and this tends to result in the formation of a vortex. Supernatant fluid entrainment then follows.

Given the inevitability of adventitious tangential velocity components resulting from filling, inert gas stirring, vessel design and the like, being present in a ladle or tundish at the beginning of teeming, the formation of a vortex and its associated funnel may account for more contamination of steel from slag than has generally been recognised before. Such a funnel will not only entrain the supernatant phase but can well result in the outflow stream being flared (i.e. non streamlined), owing to the presence therein of rotational velocity components. This flaring of the outflow stream adversely affects flow rate and, in the case steelmaking operations also results in the undesirable reoxidation of the liquid steel.

Previous devices aimed at eliminating vortices (or "vortexing" funnels) in steelmaking include castellated nozzles, floating plugs and stopper rods.

The castellated nozzle is intended to interfere with the flow of metal towards the exit nozzle, thereby tending to inhibit any rotational flows which would otherwise descend through the nozzle.

A variant of the castellated nozzle is the "ribbed" nozzle which, with a series of convex surfaces in line with the vertical axis of the outflow tend to inhibit, or at least limit, rotational flows. For a variety of reasons, these nozzles have not proved to be very effective, erosion being a major problem.

The floating plugs suffer from other disadvantages. Often the plugs do not completely shut off metal flow if the nozzle surfaces have eroded, or if the plug is not properly centered over the exit nozzle. Success rates of some 50% are typical of these plugs. By contrast, stopper rods offer an obstruction to vortexing flows that can be quite significant. It is nonetheless possible for swirling vortices to spin around an axis away from the stopper rod with attendant air or slag entrainment. Finally, stopper rods are also known to induce suction of gas from below the vessels through the drainage nozzle, thereby leading to flow instabilities, reduced flow and the possibility of reoxidation. None of these devices or techniques is completely effective in eliminating the possibility of vortexing flows.

Previous work aimed at eliminating freezing problems associated with widely-used "slide-gate" nozzle closure systems has led to the development of a variety of rotary pouring nozzles (e.g., U.S. Pat. No. 2,698,630, 3,651,998, 3,685,706, 3,760,992, 4,200,210, and 4,840,295). Such previous work teaches means to control the flow of liquid from a vessel by using an internal rotatable element within the nozzle structure so that the flow can be regulated.

U.S. Pat. No. 4,840,295 suggests that such a nozzle can reduce the likelihood of vortex formation problems but fails to recognise the parameters needed to minimise vortex formation. In a series of tests carried out using a nozzle design of equivalent geometry to that described in FIGS. 5 to 7 of U.S. Pat. No. 4,840,295, several deficiencies of the design came to light. Firstly, it was found that the presence of a supernatant "slag" phase would, even in the presence of rotational flows as low as 1 to 2 cms still lead to entrainment of the supernatant phase. From the very beginning of drainage, a significant amount of liquid was found to short-circuit its way into the drainage nozzle, leading to a rapid, funnel-like deformation of the interface between the two liquids which ultimately resulted in entrainment via a "vortexing" funnel. Secondly, the outflow stream showed considerable rotational and lateral oscillations. Thirdly, the overall discharge co-efficient of the modified nozzle was found to be significantly lower than that of a simple straight-tube nozzle of the identical exit diameter.

Such flow behaviour was prompted by the sudden acceleration of liquid at the entry ports to the nozzle, together with the significant sharp pressure drops at the respective entrances to the vertical downward nozzle, leading to the rapid entrainment and disintegration of the supernatant "slag" phase. Given the magnitude of these pressure drops along the bottom of the vessel, it was inevitable that some amount of liquid was drawn from the upper portions of the vessel (flow visualization clearly revealed the existence of helical spiral flow path-lines), and thus vortex formation and slag entrainment was inevitable. This resulted in the formation of a highly dispersed mixture of fine droplets of supernatant "slag" phase within the bulk lower "metallic" phase.

The present invention is a significant improvement over the prior art because it is designed to cause liquid exiting via the nozzle to approach the nozzle in several convergent radial streams substantially free of rotational swirl. The structure is designed to ensure that each stream travels a radial path having a length sufficient to substantially eliminate vortex entrainment, at least in the range of angular velocities normally found in steel discharge structures.

A vortex suppressing device based on the present invention can be adapted to existing metallurgical vessels without the need to modify process parameters. Additionally, the invention tends to provide a stable and compact outflow stream which is a most desirable requirement if reoxidation of the steel is to be avoided.

Accordingly, it is among the objects of this invention to address the aforementioned problems resulting from the formation of vortices or rotational flows in liquids being discharged from a container through a nozzle-like opening.

It must be ensured that the means employed to suppress downward axial flows that can lead to vortexing in a draining container should not inadvertently increase flow losses, decrease the discharge coefficient, or lead to outflow stream instabilities. Flow conditions should be so tailored as to ensure that a great proportion of the outgoing liquid is drawn radially along the vessel floor towards the nozzle, and that wherever possible very little of the surface liquid is allowed to travel through the main body of liquid to the nozzle axis.

SUMMARY OF THE INVENTION

In accordance with the invention, there is provided a flow control device consisting of a baffle plate which in use is positioned above a nozzle having a vertical axis and isolates the nozzle from direct downward flow from the surface of the liquid. Dividers space the baffle plate vertically from the nozzle and are adapted to define radial flow paths to guide and control the flow of liquid while obstructing rotational flow about said axis and permitting the liquid to flow radially under the baffle plate towards said axis before entering the nozzle.

BRIEF DESCRIPTION OF THE DRAWINGS

Exemplary embodiments of the invention are described below with reference to the accompanying drawings, in which:

FIG. 7 is a sectional view of a fourth embodiment of the invention comprising a two-part assembly wherein the inner part moves within the outer part, vertically up or down, to control and stop or start flow; and FIG. 8 is a sectional view taken on line 8—8 of FIG. 7.

DESCRIPTION OF THE PREFERRED EMBODIMENT

Figure 1:
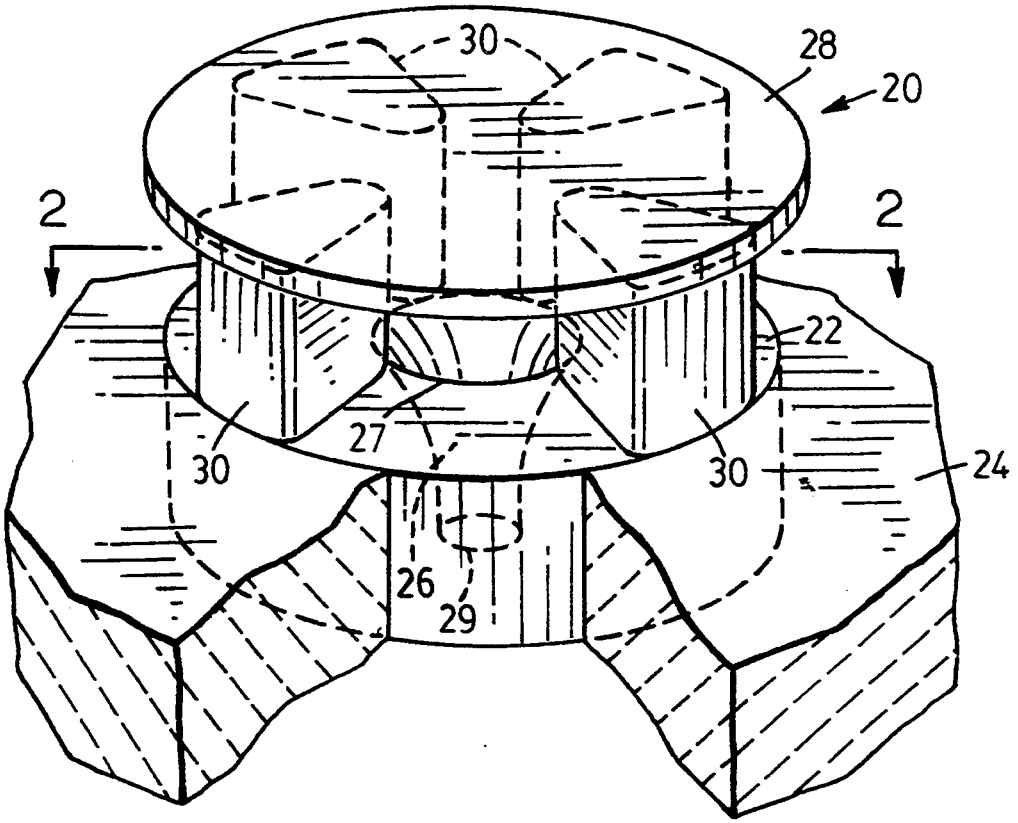
FIG. 1 is a diagrammatic isometric view of a first embodiment of the invention in use in a tundish and showing a fragmentary part of a tundish floor.

As mentioned previously, the invention is being described with reference to steelmaking and the preferred embodiment is for such use. However, to demonstrate the scope of the use within this art, the structure shown in FIG. 1 could be in a ladle, a bottom-tapped EAF, or the side wall of a BOF converter in the tilted position. As seen in FIG. 1, a flow control device 20 is in position over a nozzle 22 seated in a floor 24 of a tundish (only part of which is shown). The nozzle 22 has a centrally disposed discharge opening 26 extending longitudinally from an inlet 27 flush with the upper surface of the floor surrounds and an exit 29 terminating at or below the outside surface of the floor 24.

The flow control device 20 comprises a circular baffle plate 28 disposed to cover the nozzle 22, and lying about the axis of the nozzle, and radial dividers in the form of four dividers 30, each of which extends radially relative to said axis of the nozzle and hence of the discharge opening 26. The dividers 30 extend between the opening 26 and the circumference of the plate 28. Also, the dividers 30 support the plate 28 so as to space the plate vertically from the discharge opening 26 by a height which is at least between one-half to one times the diameter of the discharge opening 26 at the exit 29 of the nozzle. The dividers combine with the plate 28 and nozzle 22 to define a nozzle-supply volume bounded by an imaginary right circular cylinder containing the peripheries of the dividers 30. This supply volume can also be considered to be the sum of the individual radial flow paths leading liquid steel to the nozzle opening.

In use, the baffle plate 28 will isolate the nozzle opening 26 from any directional flows in the liquid contained above the plate. Such directional flows will include rotational currents in the liquid as well as currents having a predominantly axial component directed downwardly towards the nozzle and which predominate in the formation of "vortexing" funnels. Experimental work has shown that the baffle plate 28 preferably has a diameter exceeding the diameter of the discharge opening 26 at the exit 29 of the nozzle by a factor of at least 4 and preferably in the range 6 to 8 in order to effectively isolate the nozzle from such flows in the liquid and to prevent the formation of such "vortexing" funnels.

Any residual motion in the liquid entering the radial flow paths making up the nozzle-supply volume is controlled by the dividers 30 so that the flow towards the nozzle discharge opening 26 is substantially, if not entirely, horizontal. As a result, the liquid from one flow path meets liquid from the other flow paths substantially at the axis of the nozzle before passing through the nozzle.

Figure 2:
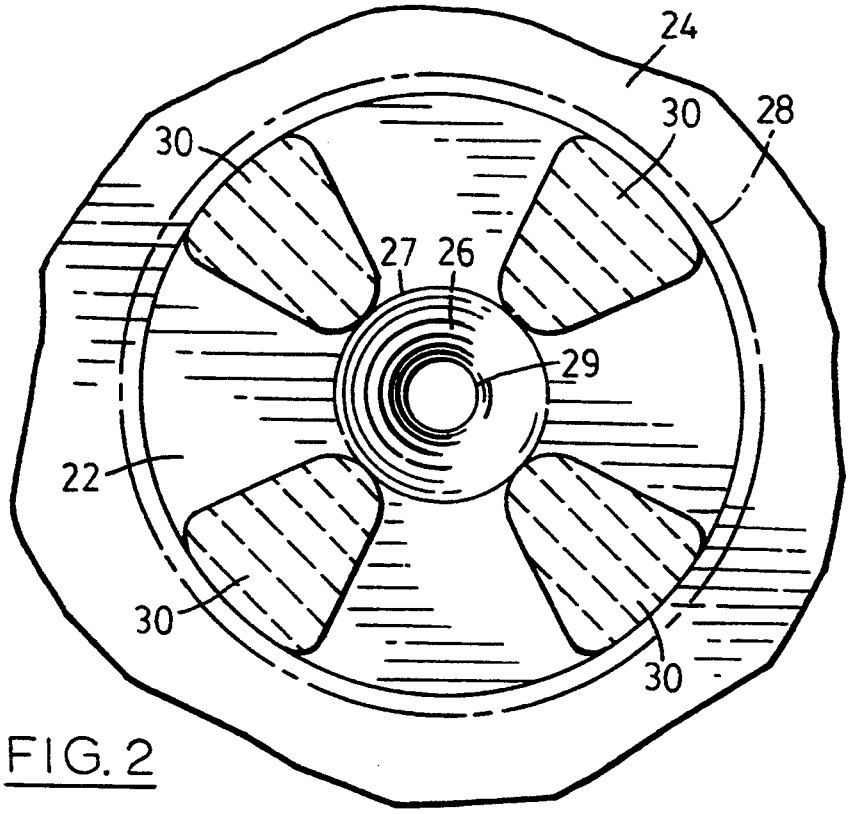
FIG. 2 is a sectional plan view on line 2—2 of FIG. 1.

In order to minimize flow separation at the nozzle and the consequent deposition of any inclusions in the vicinity of the nozzle, the divider surfaces are smoothly contoured as more clearly shown in the cross-sectional view of FIG. 2. For simplicity in drawing, the number of dividers has been restricted to four but it will be appreciated that the number may vary according to the application and the dimensions of the associated nozzle. It will also be apparent that the cross-section of the baffle plate, and the smallest section of the dividers are not critical to vortex suppression performance. Consequently, their shapes and dimensions should be chosen on the basis of projected mechanical strength and erosion-resistance requirements.

Experimental results have shown that the outflow stream of liquid leaving the discharge opening 26 through the nozzle of a flow control device 20 can be tight and compact without noticeable flaring or entrainment of the surrounding atmosphere (gas below the floor 24). This is best achieved using a total cross-sectional area for flow paths between the dividers which is at least as great as the cross-sectional area for flow through the nozzle. The liquid supply to the nozzle opening 26 is then not restricted by the device.

As a result of using the device, flow adjacent the nozzle is made to approach the nozzle radially so that the nozzle is continuously being fed by a slow flow of liquid from the periphery of the device and essentially horizontally along the floor of the vessel. It is well known that impurities in steel will tend to float upwards and because the nozzle is being fed from the liquid at the bottom, there is more likelihood that any impurities will rise into the slag out of the steel being drawn into the nozzle.

Furthermore, by suppressing vortexing funnel formation, the device 20 allows an operator to proceed with a more complete emptying of the tundish (without any danger of slag entrainment). This allows for a greater recovery of the liquid steel from the process. Such improvement in the yield of liquid steel is likely to be a major economic benefit of using the device.

Figure 3:
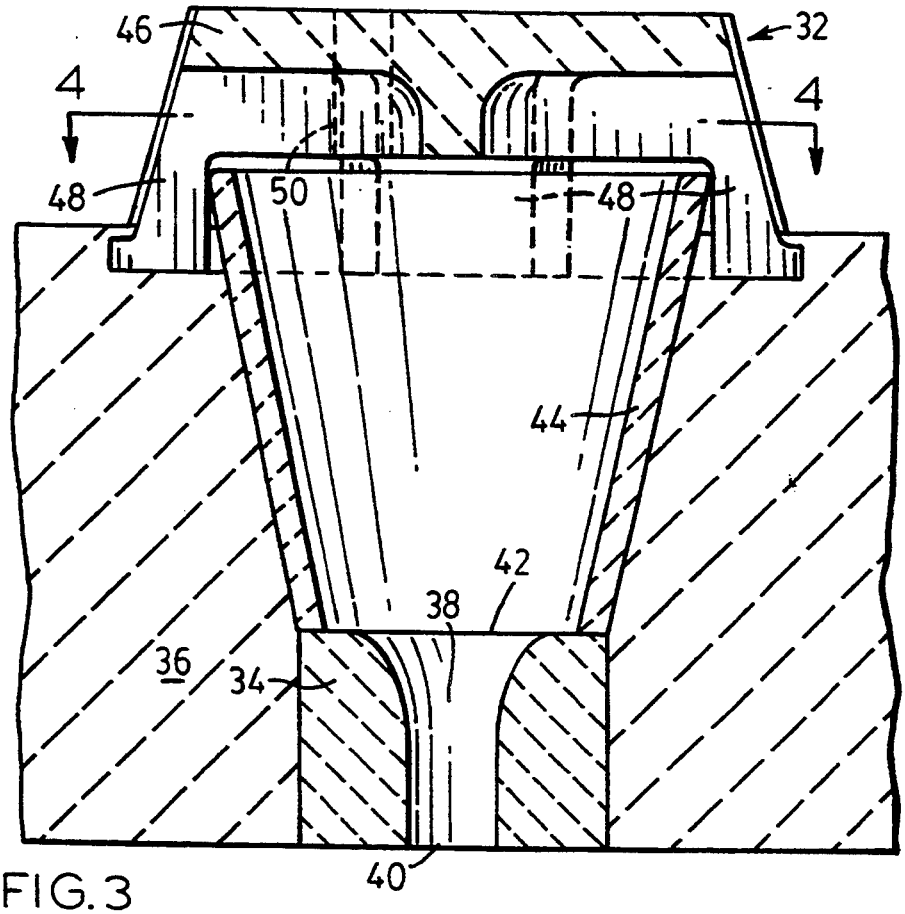
FIGS. 3 and 4 are complementary sectional views of a second embodiment of the invention, FIG. 3 being a sectional side view on line 3—3 of FIG. 4, and FIG. 4 being a sectional plan view on line 4—4 of FIG. 3.
Figure 4:
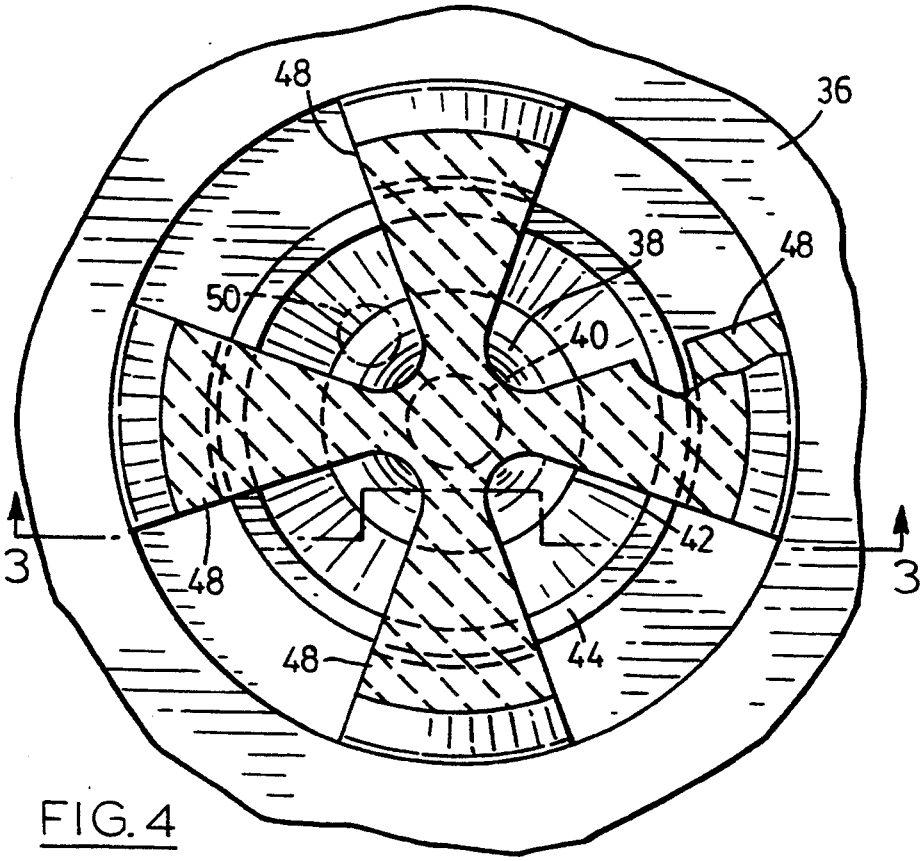

An alternative embodiment of the invention is shown in FIGS. 3 and 4, for use with a TUNDAK (trademark of Foseco International Limited) cone which is commonly used with metallurgical vessels. A flow control device 32 is used in association with a nozzle 34 recessed in the floor 36 of the vessel and the nozzle has a discharge opening 38 and exit 40. This exit 40 is normally flush with the outside surface of the floor 36.

An inlet 42 is downwardly spaced from the top surface of the floor and the TUNDAK cone 44 lines the floor 36 and defines the opening through the floor 36 through which liquid metal is to be discharged from the vessel. In accordance with normal practice, the TUNDAK cone stands proud of the floor of the tundish.

In this embodiment of the invention, the device 32 comprises a baffle plate 46 which again is circular and has a diameter which approximates the diameter of the TUNDAK cone where it meets the upper surface of the floor 36. The TUNDAK cone normally has a diameter more than four times that of the diameter of the exit 40 so that the plate 46 continues to be effective in isolating any directional flows in the liquid from the nozzle 34. However, the nozzle supply volume is increased by the addition of the TUNDAK cone and it is therefore preferable to provide dividers 48 which extend between the circumference of the plate 46 and the centre of the plate 46 thereby traversing the discharge opening 38. This arrangement effectively arrests any residual rotational motion in the liquid entering the TUNDAK cone by maintaining radial flow paths as the liquid moves horizontally before travelling through the cone.

Because the TUNDAK cone stands proud of the tundish floor, it will be understood that any chilling of a stagnant steel layer against the floor will not obstruct the passages for liquid metal flow between the dividers 48.

It is customary with this type of nozzle and cone combination for ladle applications to fill the cone 44 with sand prior to filling the vessel with molten metal to avoid metal freezing problems. In such metallurgical vessels the nozzle sand also acts as a nozzle plug which prevents metal flow from starting prematurely during the initial filling-up period. Once a certain minimum liquid metal head has been built up within the vessel and/or when the liquid metal is ready to be discharged from the vessel, the sand is released through the nozzle 34 and the metal flows without blocking the nozzle. Clearly, access must be provided to pour sand into place. This can, among other ways, be effected by providing a hole 50 (shown in chain-dotted outline) in the baffle plate 46. In tundish applications, this procedure has not been found to be necessary.

The hole 50 lies between a pair of dividers 48 and is typically about one to three inches (2.5 to 7.5 cm.) in diameter. Experimental results have shown that the presence of a hole in the baffle plate (even at the centre) does not necessarily permit axial velocities to dominate the radial flow set up and controlled by the device.

Experimental trials conducted using a device 32 of the kind described above with reference to FIGS. 3 and 4 have shown that the outflow stream from the tundish nozzle is relatively superior with less roping and flaring, and smoother flow than the flow out of a tundish nozzle which is not fitted with a device in accordance with the invention.

In the trials, the device 32 (excluding nozzle sand filling hole 50) was fabricated from low cement, low moisture, high alumina castable recipes Foscast 82 and Foscast 70 (trademarks of Foseco International Limited), the latter proving to be the superior of the two recipes.

The devices were installed in a 4-strand, 12-ton tundish, which produced 4"×4" billets at a nominal casting speed of 125 in/min/strand, or 235 Kg/min/strand.

The devices were easily installed by simply pressing into the Tuncast sprayed (Tuncast is a trademark of Foseco International Limited) bottom of the tundish. The devices became entrenched in place when the Tuncast spray lining was dried in accordance with normal practice.

The devices did not require any pre-heating, allowed excellent free-opening of the strands—no freezing problems at the beginning of casting, and survived the normal four to five ladle sequences, without interference with normal caster operations.

Figure 5:
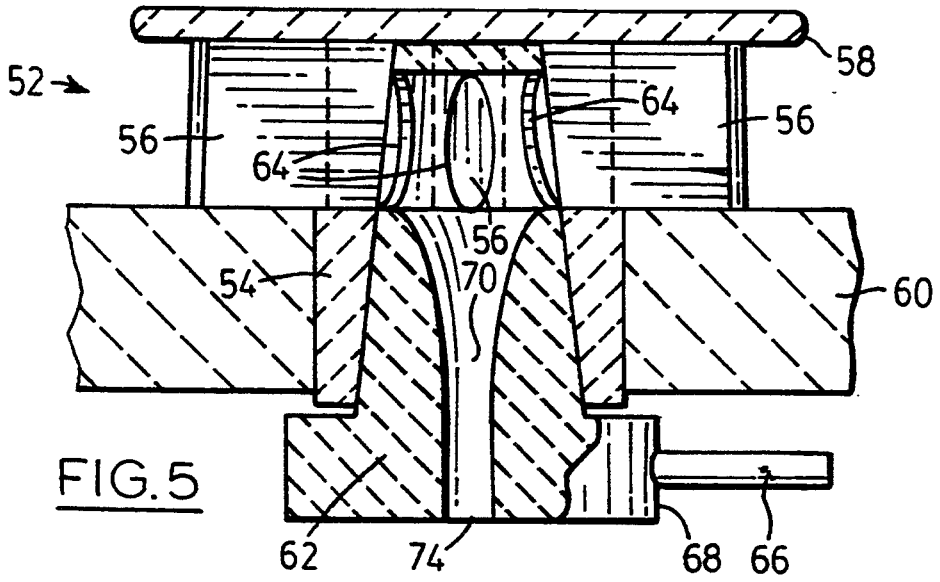
FIG. 5 is a diagrammatic sectional view of a third embodiment of the invention comprising a two-part assembly, the inner part of which rotates within the fixed outer part to control, to stop or start flow.
Figure 6:
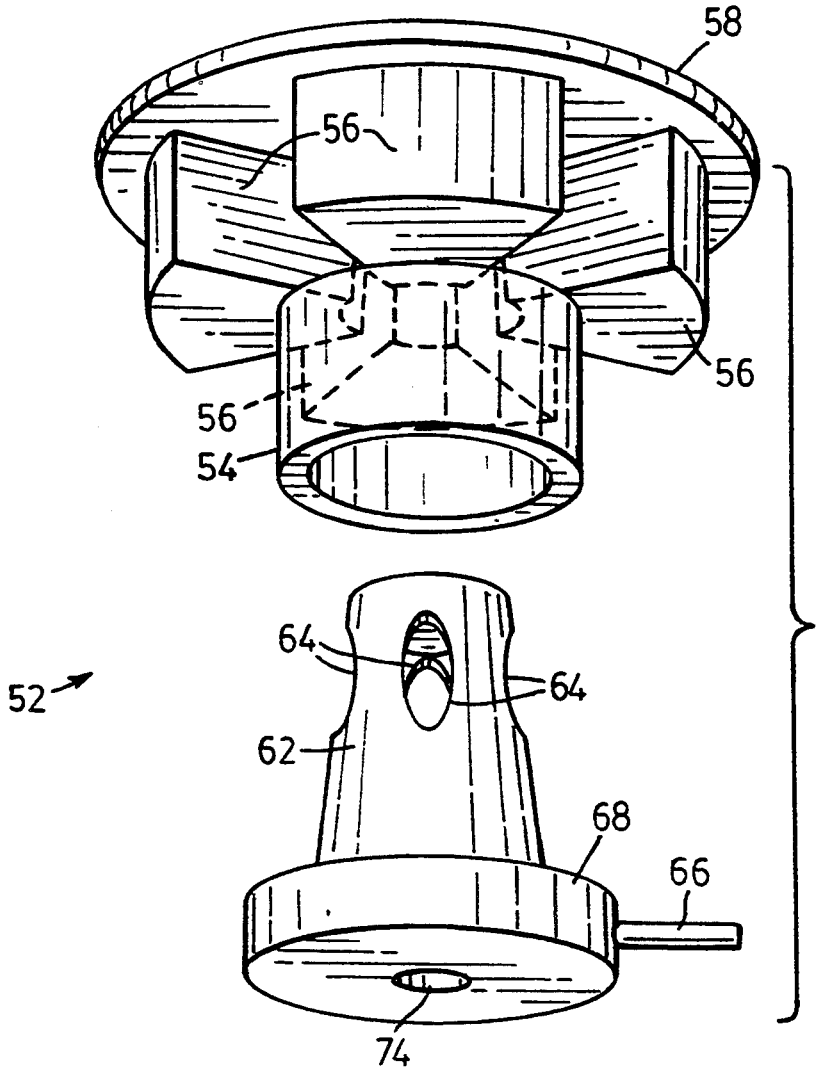
FIG. 6 is an isometric view of the two parts of FIG. 5 prior to assembly.

A third embodiment of the invention is shown in FIGS. 5 and 6 and is generally indicated by numeral 52. Here a flow control device according to the invention has an integral nozzle 54 defined by a cylinder disposed centrally beneath four dividers 56 (three of which are seen in FIG. 5) which extend radially between the nozzle and the circumference of an overlying circular plate 58. In FIG. 5 the device 52 is shown with the nozzle 54 penetrating through a floor 60 of a vessel or container.

A flow obturator 62 comprising an inner sleeve dimensioned to fit snugly within the nozzle 54 has four longitudinally extending rounded slots 64 at the upper end disposed to be brought into and out of registration with gaps between the dividers 56 upon rotation of the obturator within the nozzle. A handle 66 disposed on a shoulder 68 at the outer end of the obturator 62 is provided to illustrate an actuator diagrammatically. The device is shown "closed" in FIG. 5.

In this embodiment of the invention, it will be understood that the discharge opening through the nozzle is defined by an axial opening 70 (FIG. 5) through the obturator 62 having an exit 74.

Here again, the baffle plate 58 operates to isolate directional flows in the liquid from the nozzle, while the dividers 56 divert any rotational flows, so that the liquid entering the discharge opening 70 between the dividers will have a direction of motion which is primarily radial to the opening. Rotation of the flow obturator 62, to bring the slots 64 into and out of registration with the dividers 56, may be used to vary the nozzle-supply volume of liquid so as to regulate flow through the nozzle as required by prevailing conditions in the vessel.

A fourth embodiment of the invention is shown diagrammatically in FIGS. 7 and 8, and is generally indicated by numeral 82. Here the flow control device 82 has an integral nozzle 84 defined by a cylinder disposed centrally beneath four dividers 89 which extend radially between the nozzle and the circumference of an overlying circular plate 88. In FIG. 7 the device 82 is shown with the nozzle 84 penetrating through a floor 90 (and steel shell 92) of a vessel or container. A flow obturator 94 comprising an inner sleeve is dimensioned to fit snugly within the nozzle 84 and includes at its upper end a cruciform section comprising arms 86 (FIG. 8) which extend the radial dividers 89 of the nozzle 84 towards the centre of the device 82 and define therebetween channels for liquid flow. The arms 86 are spaced downwardly from an end 87 which is received in a complementary recess 91 formed in the underside of the plate 88 and which guides the obturator during axial movement. The body 94 can be moved axially into and out of the nozzle-supply volume defined by said channels for liquid flow between the dividers 89, by actuating a set of hydraulic pistons 104 and the movement thereby controls the volumetric flow through the nozzle. In normal use, the obturator would be withdrawn so as to maximize liquid metal flow through the passages into a centrally disposed discharge opening 98 extending from an inlet at the lower surface of the arms 86 to an exit 102 on the outer surface of the obturator 94.

It will be understood that the incorporation of a porous brick, in the form of a ring embedded in the nozzle 54 of FIG. 5 and in the nozzle 84 of FIG. 7 flush with the interface with the obturator (62 and 94 as the case may be), along with means to deliver inert gas into this porous brick, will provide gas film lubrication between the moving parts and also guard against the possibility of metal leaking at the interface.

Variations to the above-described embodiments of the invention and equivalents to these embodiments are within the scope of the appended claims.

We claim:

1. A flow control device for the suppression of rotational flow in a liquid being discharged vertically through a nozzle having a vertical axis and a discharge opening extending axially from an inlet to an exit, the device comprising the following elements:

a baffle plate disposed in use above the nozzle, and radial dividers disposed about the longitudinal axis of the discharge opening and supporting the baffle plate so as to space the baffle plate axially from the discharge opening, the dividers defining radial flow paths having a combined cross-sectional area at least as great as the cross-sectional area for flow through the nozzle, the dividers being adapted to obstruct rotational forces in the liquid so that the liquid flows along the flow paths radially and horizontally towards the nozzle where the flow paths meet and the liquid then passes axially from the flow paths and through the nozzle.

2. A device according to claim 1 in which the nozzle is integral with the device.

3. A device according to claim 1 in which the baffle plate is circular and has a diameter which is at least four times greater than the diameter of the discharge opening at the exit of the nozzle.

4. A device according to claim 1 in which the baffle plate is circular and has a diameter which is at least six to eight times greater than the diameter of the discharge opening at the exit of the nozzle.

5. A device according to claim 1 in which the baffle plate has a hole adapted to allow the nozzle to be filled with particulate material prior to discharge.

6. A device according to claim 5 in which the hole is eccentric relative to said longitudinal axis of the discharge opening.

7. A device according to claim 1 in which the dividers space the baffle plate from the discharge opening by a height which is no less than one-half the diameter of the discharge opening measured at the exit of the nozzle.

8. A device according to claim 1 in which the dividers traverse the discharge opening at the inlet of the nozzle.

9. A device according to claim 1 in which the dividers extend between the discharge opening and the circumference of the baffle plate.

10. A device according to claim 1 in which the nozzle is integral with the device and the nozzle includes a flow obturator comprising an inner sleeve with longitudinally extending slots corresponding in number to the dividers, the flow obturator being rotatable about the discharge opening so that the slots may be brought into and out of registration with the dividers and thereby regulate the flow of liquid discharged.

11. A device according to claim 1 in which the nozzle is integral with the device and the nozzle includes a flow obturator comprising an inner sleeve moveable axially relative to the discharge opening to thereby regulate the flow of liquid discharged.

* * * * *